US009159312B1

(12) United States Patent
Tom

(10) Patent No.: US 9,159,312 B1
(45) Date of Patent: Oct. 13, 2015

(54) AUDIO DEVICE WITH PRIVACY MODE

(75) Inventor: Kevin Tom, San Francisco, CA (US)

(73) Assignee: Google Inc., Mountain View, CA (US)

( * ) Notice: Subject to any disclaimer, the term of this patent is extended or adjusted under 35 U.S.C. 154(b) by 804 days.

(21) Appl. No.: 13/159,724

(22) Filed: Jun. 14, 2011

(51) Int. Cl.
*G10K 11/16* (2006.01)
*G10K 11/175* (2006.01)
*H04R 3/02* (2006.01)

(52) U.S. Cl.
CPC ..... *G10K 11/175* (2013.01)

(58) Field of Classification Search
CPC ..... G10K 11/175; G10K 11/161; G10K 11/1784; H04R 2499/13; H04K 1/02; H04K 2203/12
USPC ..... 381/71.8, 71.9, 77, 71.2, 73.1
See application file for complete search history.

(56) References Cited

U.S. PATENT DOCUMENTS

| | | | | |
|---|---|---|---|---|
| 7,103,187 | B1 * | 9/2006 | Neuman | 381/59 |
| 8,170,229 | B2 * | 5/2012 | Kesterson | 381/71.8 |
| 2007/0041590 | A1 * | 2/2007 | Tice | 381/77 |
| 2010/0150361 | A1 * | 6/2010 | Kim et al. | 381/59 |

* cited by examiner

*Primary Examiner* — Vivian Chin
*Assistant Examiner* — Ammar Hamid
(74) *Attorney, Agent, or Firm* — Brake Hughes Bellermann LLP

(57) ABSTRACT

A device includes an audio processor, a first speaker, and a second speaker. The audio processor is configured to receive an audio signal. The first speaker is operatively coupled to the audio processor and is configured to produce a first sound wave. The first sound wave is associated with the audio signal. The second speaker is operatively coupled to the audio processor and is configured to produce a second sound wave. The second sound wave is configured to at least partially cancel the first sound wave.

23 Claims, 7 Drawing Sheets

AUDIO DEVICE WITH PRIVACY MODE

TECHNICAL FIELD

This description relates an audio device that includes a privacy mode and more specifically to an audio device that is configured to transmit a sound wave and a sound cancelling wave.

BACKGROUND

Portable electronic devices, including those that transmit sounds, are frequently used in public places. The audio and sounds that are emitted from such devices may be disruptive to those not using the devices. Additionally, some users of such devices may wish to keep the sounds of their devices private and away from the listening ears of those around them.

To limit the reach of sounds that are emitted from electronic devices, some users utilize headphones. Headphones, however, can prevent the user from interacting with others. Additionally, headphones can be uncomfortable and/or not available to the user. Finally, some headphones may not efficiently limit the sounds transmitted by the electronic devices.

SUMMARY

In one implementation, a device includes an audio processor, a first speaker, and a second speaker. The audio processor is configured to receive an audio signal. The first speaker is operatively coupled to the audio processor and is configured to produce a first sound wave. The first sound wave is associated with the audio signal. The second speaker is operatively coupled to the audio processor and is configured to produce a second sound wave. The second sound wave is configured to at least partially cancel the first sound wave.

In one implementation, a method of transmitting sound waves includes transmitting a first sound wave from a first speaker of a device, calculating a second sound wave, and transmitting the second sound wave from a second speaker of the device. In some implementations, the second sound wave is configured to cancel the first sound wave.

In some implementations, a computer program product tangibly embodied on a computer-readable medium and comprising instructions that, when executed, are configured to cause at least one processor to receive a first sound wave, calculate a second sound wave, the second sound wave being configured to at least partially cancel the first sound wave, cause the first sound wave to be produced from a first speaker, and cause the second sound wave to be produced from a second speaker.

The details of one or more implementations are set forth in the accompanying drawings and the description below. Other features will be apparent from the description and drawings, and from the claims.

DETAILED DESCRIPTION

Figure 1:
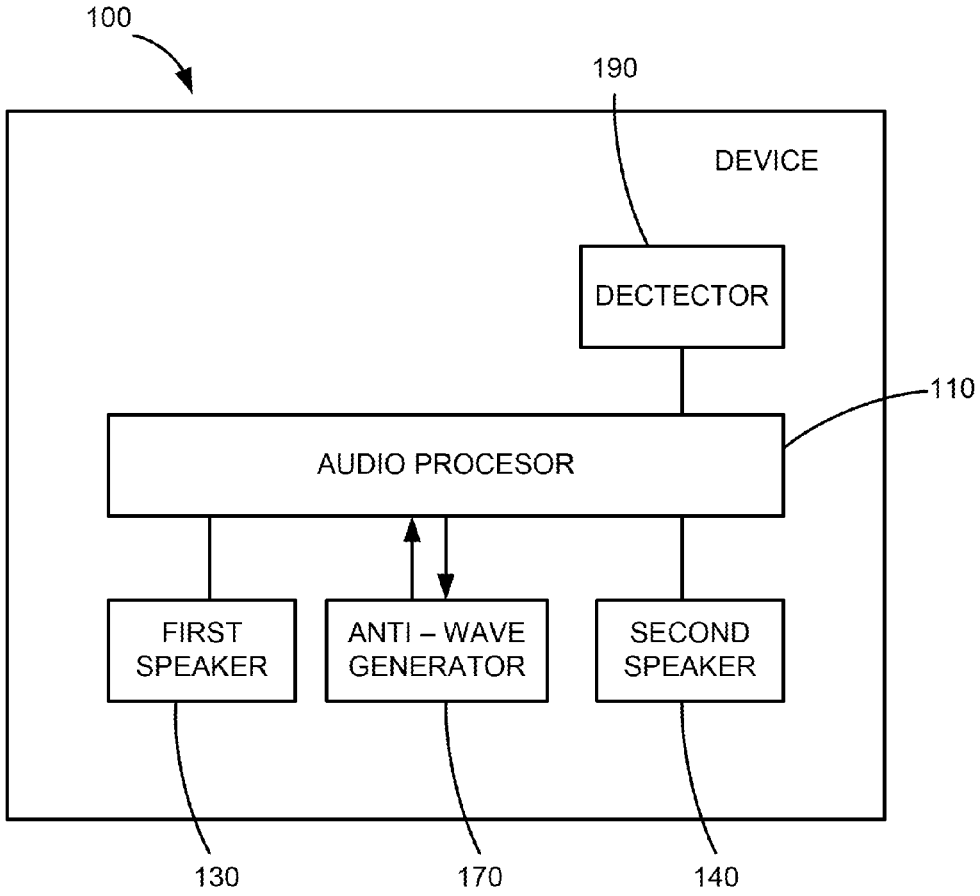
FIG. 1 is a schematic diagram of an example device according to an implementation.

FIG. 1 is a schematic diagram of a device 100. The device may be any type of device that is configured to produce, emit, or transmit sound. For example, in some implementations, the device 100 is a computer (such as a laptop computer), a phone, a portable music device, a radio, a television. In other implementations, the device 100 is another device that is configured to produce, emit, or transmit sound or sounds. In some implementations, the device 100 is portable. In other words, in some implementations, the device 100 is sized such that a user may carry or easily transport the device 100. In other implementations, the device 100 is not easily portable and is configured to remain in a single location. In other words, in such implementations, the device 100 is sized such that it is too large or too heavy for a user to easily carry or transport the device 100.

The device 100 includes an audio processor 110, a first speaker 130, and a second speaker 140. The audio processor 110 is operatively coupled to the first speaker 130 and to the second speaker 140. In some implementations, the audio processor 110 is configured to control the relative phases of sound waves emitted from the first speaker 130 and the sound waves emitted from the second speaker 140. In some implementations, the audio processor 110 is configured to cause the first and second speakers to emit sound waves that have different relative phases.

The audio processor 110 is configured to receive an audio signal. For example, in some implementations, the audio processor 110 is configured to receive an audio signal that is associated with a sound or sounds (such as an audio stream). In some implementations, the audio processor 110 is an audio processing chip. In some implementations, the audio processor 110 is an audio card, such as an audio card configured to be used within a laptop computer or other similar type device. In other implementations, the audio processor 110 is software stored in a memory of the device 100 (such as in a hard drive or other memory of the device 100).

In some implementations, one or more of the components or modules of the device 100 (including the audio processor 110) can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed by a computer). For example, in some implementations, the audio processor 110 can be, or can include, a software module configured for execution by at least one processor (not shown). In some implementations, the functionality of the modules or components can be included in different modules and/or components than those shown in FIG. 1. For example, although not shown, the functionality of the audio processor 110 can be included in a different component or module within the device 100.

Figure 1A:
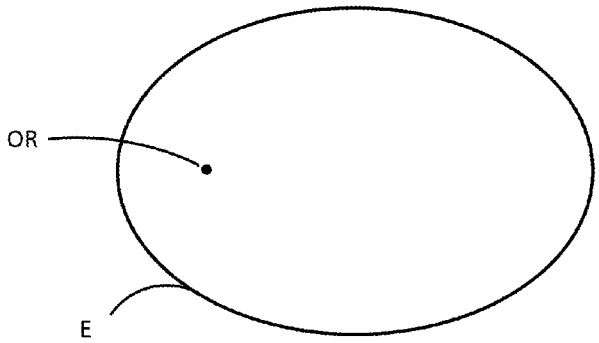
FIG. 1A is a schematic illustration of an intensity profile of a sound wave.

The first speaker 130 is operatively coupled to the audio processor 110. The first speaker 130 is configured to produce, transmit, or emit sound waves. For example, in some implementations, the first speaker 130 is configured to receive an electrical signal corresponding to a sound wave from the audio processor 110 and to produce or emit the sound wave from the device 100. In some implementations, the first speaker 130 is configured to direct sound waves in a primary direction (and configured either to not direct sound waves in a second direction or to direct less forceful or weaker sound waves in a second direction). For example, in some implementations, the first speaker 130 is configured to emit anisotropic sound waves, or sound waves that have a spatial profile that is anisotropic (in other words, the intensity of the sound wave is greater at a first location than at a second location when the first and second locations are disposed equal distances from the first speaker). FIG. 1A illustrates a sound wave E that emitted from a speaker at an origin OR and has a spatial profile that is anisotropic (the intensity of the wave is greater to the right of the origin OR than it is to the left). In such implementations, the sound waves emitted or transmitted by the first speaker in a first direction are stronger than the sound waves emitted by the first speaker in a second, different direction.

In some implementations, the first speaker 130 is a directional speaker (a speaker configured to emit sound waves in a primary direction). In some implementations, the first speaker 130 is a dome type speaker (such as a directional dome speaker). In other implementations, the first speaker 130 is a cone speaker. In such implementations, sound dampening or insulating material may be disposed adjacent the cone speaker to help dampen or prevent sound waves from being emitted in a secondary direction. In other implementations, the first speaker 130 is another type of speaker known in the art.

The second speaker 140 is operatively coupled to the audio processor 110. The second speaker 140 is configured to produce, transmit, or emit sound waves. For example, in some implementations, the second speaker 140 is configured to receive an electrical signal corresponding to a sound wave from the audio processor 110 and to produce or emit the sound wave from the device 100. In some implementations, the second speaker 140 is configured to direct sound waves in a primary direction (and configured either to not direct sound waves in a second direction or to direct less forceful or weaker sound waves in a second direction). For example, in some implementations, the second speaker 140 is configured to emit sound waves that have an anisotropic spatial profile. In such implementations, the sound waves emitted or transmitted by the first speaker in a first direction are stronger or of a greater intensity than the sound waves emitted by the first speaker in a second, different direction.

In some implementations, the second speaker 140 is a directional speaker (a speaker configured to emit sound waves in primary direction). In some implementations, the second speaker 140 is a dome type speaker (such as a directional dome speaker). In other implementations, the second speaker 140 is a cone speaker. In such implementations, sound dampening or insulating material may be disposed adjacent the cone speaker to help dampen or prevent sound waves from being emitted in a secondary direction. In other implementations, the second speaker 140 is another type of speaker known in the art.

Figure 1B:
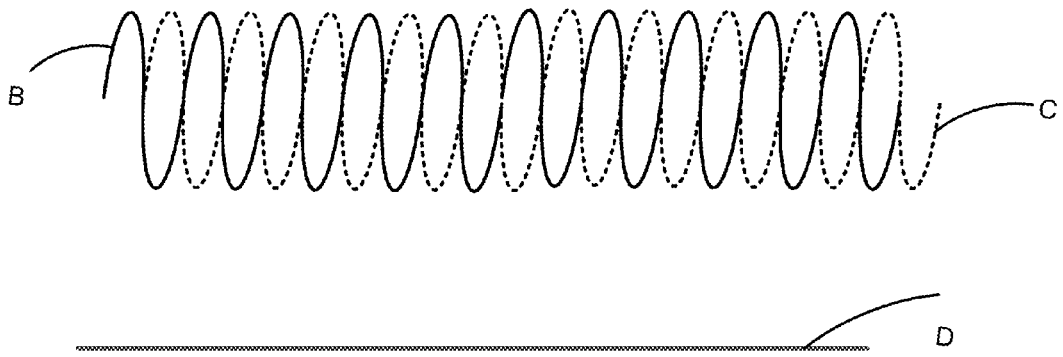
FIG. 1B is a schematic illustration of a sound wave being canceled by it anti-wave.

In some implementations, the second speaker 140 is configured to produce or emit a sound wave that cancels the sound wave produced by the first speaker 130. In some implementations, the second speaker 140 is configured to produce or emit the sound wave that cancels the sound wave produced by the first speaker 130 at the same time the first speaker 130 produces the sound wave. For example, as illustrated in FIG. 1B, the second speaker 140 may be configured to produce or emit a sound wave B that cancels the sound wave C produced by the first speaker 130. The combined wave D produces no sound. In some implementations, the second speaker 140 is configured to emit a sound wave that has the same frequency spectrum as the sound wave emitted by the first speaker 130.

In some implementations, the speakers 130 and 140 produce the sound wave and the canceling wave, respectively, simultaneously. In other words, the sound wave and the canceling wave are produced at the same time. In some implementations, the sound wave and the canceling wave are not produced simultaneously.

In some implementations, the second speaker 140 is configured to produce or emit a sound wave that completely disrupts or cancels the sound wave produced by the first speaker 130. In such implementations, an individual that is exposed to both the sound wave of the first speaker 130 and the sound wave of the second speaker 140 does not hear or otherwise perceive either of the sound waves (and hears no sound). In other implementations, the second speaker 140 is configured to produce a sound wave that partially disrupts or partially cancels the sound wave produced by the first speaker 130. In such implementations, an individual exposed to both the sound wave of the first speaker 130 and the sound wave of the second speaker 140 does not completely hear the sound associated with the sound wave of the first speaker 130. For example, the sound that such individual hears is a limited, muffled, or otherwise disrupted or unrecognizable.

In some implementations, the second speaker 140 is configured to produce or emit a sound wave that is the anti-wave of the sound wave produced by the first speaker 130. In such implementations, the sound wave produced by the second speaker 140 (which is the anti-wave of the sound produced by the first speaker 130) combines with and cancel out the sound wave produced by the first speaker 130. Accordingly, an individual that receives or is exposed to the sound wave produced by the first speaker 130 and the sound wave that is produced by the second speaker 140 (the anti-wave of the sound wave produced by the first speaker 130) would not hear or recognize any sound.

In other implementations, the second speaker 140 is configured to produce or emit a sound wave that is substantially similar to the anti-wave of the sound wave produced by the first speaker 130. In such implementations, the sound wave produced by the second speaker 140 (which is substantially similar to the anti-wave of the sound produced by the first speaker 130) combines with and at least partially cancels out the sound wave produced by the first speaker 130. Accordingly, an individual that receives or is exposed to the sound wave produced by the first speaker 130 and the sound wave that is produced by the second speaker 140 (a sound wave that is substantially similar to the anti-wave of the sound wave produced by the first speaker 130) would not hear or recognize the sound associated with the sound wave produced by the first speaker 130. For example, in some implementations, such an individual would hear a limited, muffled, or otherwise unrecognizable sound.

In some implementations, the first speaker 130 is configured to emit sound waves from the device 100 and direct them preferentially in a first direction. For example, in some implementations, the first speaker 130 is configured to emit an anisotropic sound wave in a primary direction (and to not emit or to emit an attenuated sound wave, or a sound wave that has a lower intensity, in other directions). The second speaker 140 is configured to emit sound waves from the device 100 and direct them preferentially in a second direction different than the first direction. For example, in some implementations, the second speaker 140 is configured to emit an anisotropic sound wave in a primary direction (and to not emit or to emit an attenuated sound wave, or sound wave that has a lower intensity, in other directions). In such implementations, individuals may be positioned with respect to the device 100 such that they receive preferentially the sound waves produced by the first speaker 130 compared to the sound waves produced by the second speaker 140. Such individuals will perceive or hear the sounds associated with the sound waves produced by the first speaker 130. Also in such implementations, individuals may be positioned with respect to the device 100 such that they receive the sound waves produced by the first speaker 130 and the second speaker 140. In some implementations, such individuals will not perceive or hear any sounds associated with the sound waves produced by the first speaker or the second speaker (or will hear a partially canceled or disrupted sound associated with the sound wave produced by the first speaker). In some implementations, such individuals would receive or hear the sounds associated with the sound waves produce by the first speaker 130 at a lower intensity than those who receive them at the first location.

In some implementations, the first speaker 130 is configured to emit sound waves from the device 100 to a first location and a second location different than the first location and the second speaker 140 is configured to emit sound waves from the device 100 to the second location and not to the first location. In such implementations, individuals may be positioned at the first location such that they receive the sound waves produced by the first speaker 130 and do not receive the sound waves produced by the second speaker 140. Such individuals will perceive or hear the sounds associated with the sound waves produced by the first speaker 130. Also in such implementations, individuals may be positioned at the second location such that they receive the sound waves produced by the first speaker 130 and the second speaker 140. Such individuals will not perceive or hear any sounds associated with the sound waves produced by the first speaker or the second speaker (or will hear a partially canceled or disrupted sound associated with the sound wave produced by the first speaker).

In some implementations, the first speaker 130 and the second speaker 140 are fixedly coupled to the device 100. In such implementations, the first speaker 130 and the second speaker 140 are at a fixed distance and orientation from each other. In other implementations, the first speaker 130 and/or the second speaker 140 are movably coupled to the device 100. For example, in some implementations, the first speaker 130 and/or the second speaker 140 are configured to move from one location of the device 100 to another location of the device 100. In other implementations, the first speaker 130 and/or the second speaker 150 are configured to move with respect to the device 100 such that they are configured to emit anisotropic sound waves or direct sound waves in different directions with respect to the device 100 (and to each other).

Although the device 100 is illustrated and described as including a first speaker 130 and a second speaker 140, the device 100 may include any number of speakers. For example, in some implementations, the device 100 includes a third speaker (not illustrated) and a fourth speaker (not illustrated). For example, in such implementations, the third speaker may be configured to emit sound waves associated with a sound (for example, to collectively with the first speaker to emit a stereo sound). The fourth speaker may be configured to produce or emit a sound wave that is configured to cancel or partially cancel the sound wave produced by the third speaker.

In some implementations, the third speaker is configured to emit sound waves from the device 100 in a first direction (either the same direction or different direction than a direction in which the first speaker emits sound waves) and the fourth speaker is configured to emit sound waves from the device 100 in a second direction different than the first direction. In such implementations, individuals may be positioned with respect to the device 100 such that they receive the sound waves produced by the third speaker and do not receive the sound waves produced by the fourth speaker. Such individuals will perceive or hear the sounds associated with the sound waves produced by the third speaker. Also in such implementations, individuals may be positioned with respect to the device 100 such that they receive the sound waves produced by the third speaker and the fourth speaker. Such individuals will not perceive or hear any sounds associated with the sound waves produced by the third speaker or the fourth speaker (or will hear a partially canceled or disrupted sound associated with the sound wave produced by the third speaker).

In some implementations, the second speaker is configured to emit sound waves, such as anisotropic sound waves, from the device 100 to a first location (the same location or different location than the location to which the first speaker 130 emits sound waves) and a second location different than the first location and the fourth speaker is configured to emit sound waves, such as anisotropic sound waves, from the device 100 to the second location and not to the first location. In such implementations, individuals may be positioned at the first location such that they receive the sound waves produced by the third speaker and do not receive the sound waves produced by the fourth speaker. Such individuals will perceive or hear the sounds associated with the sound waves produced by the third speaker. Also in such implementations, individuals may be positioned at the second location such that they receive the sound waves produced by the third speaker and the fourth speaker. Such individuals will not perceive or hear any sounds associated with the sound waves produced by the third speaker or the fourth speaker (or will hear a partially canceled or disrupted sound associated with the sound wave produced by the first speaker).

In some implementations, the device 100 includes a display (not illustrated). In such implementations, the display may provide visual outputs that correspond to the sound or sets of sounds produced by the first speaker 130.

In the illustrated implementation, the device 100 includes an anti-wave generator 170. The anti-wave generator 170 is configured to calculate or otherwise determine an anti-wave (or inverse wave) of a sound or a set of sounds (such as an audio stream). For example, in some implementations, the anti-wave generator 170 is configured to receive a sound or set of sounds and to calculate the anti-wave of such sound or set of sounds.

In the illustrated implementation, the anti-wave generator 170 is operatively coupled to the audio processor 110. In such an implementation, the audio processor 110 provides a sound (or set of sounds) that is to be emitted from the device 100. The anti-wave generator 170 calculated or determines the anti-wave of the sound or set of sounds to the audio processor 110. The audio processor 110 then communicates with the first speaker 130 to have the first speaker 130 to emit the sound wave associated with the sound (or set of sounds) and communicates with the second speaker 140 to have the second speaker 140 emit the anti-wave of the sound wave associated with the sound (or the set of sounds).

In some implementations, the anti-wave generator 170 is configured to determine or calculate a wave that is substantially similar to the anti-wave of the sound or set of sounds provided to it. For example, in some implementations, the anti-wave generator 170 is configured to calculate or determine a wave that will cancel or substantially cancel the sound wave of the sound or set of sounds provided to it.

In some implementations, the anti-wave generator 170 accommodates for various features of the speakers 130 and 140 when calculating the anti-wave of the sound provided to it (or the wave that is configured to cancel or substantially cancel the sound wave of the sound that is provided to it). For example, in some implementations, the anti-wave generator 170 takes into account the distance of the first speaker 130 from the second speaker 140 when calculating the anti-wave. Accordingly, in some implementations, the sound wave emitted from the second speaker 140 (the anti-wave) may be offset (by the distance between the speakers 13 and 140) fro the sound wave emitted from the first speaker 130. In some implementations, the anti-wave generator 170 takes into account the relative direction of the first speaker 130 and the second speaker 140.

In some implementations, the anti-wave generator 170 is an audio card, such as an audio card configured to be used within a laptop computer or other similar type device. In other implementations, the anti-wave generator 170 includes an audio processing chip or includes software stored in a memory of the device 100 (such as in a hard drive or other memory of the device 100).

In some implementations, one or more of the components or modules of the device 100 (including anti-wave generator 170) can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed by a computer). For example, in some implementations, the anti-wave generator 170 can be, or can include, a software module configured for execution by at least one processor (not shown). In some implementations, the functionality of the modules or components can be included in different modules and/or components than those shown in FIG. 1. For example, although not shown, the functionality of the anti-wave generator 170 can be included in a different component or module (such as the audio processor 110) within the device 100.

In some implementations, the device 100 includes a detector 190. The detector 190 is configured to detect the characteristics of the user or users of the device 100. For example, in some implementations, the detector 190 is configured to determine the distance between the device 100 and the user of the device 100. In other implementations, the detector 190 is configured to determine the relative location of the user of the device 100 with respect to the device 100. In yet further implementations, the detector 190 is configured to determine the number of users using the device 100.

The detector 190 is operatively coupled to the audio processor 110 and is configured to provide information detected about the user of the device 100 to the audio processor 110. The audio processor 110 may control the speakers 130 and 140 according to the information provided to it by the detector 190. For example, in some implementations, the audio processor 110 may adjust the sound levels (or the relative sound levels) of the speakers depending on the distance of the user from the device. Also, in some implementations, the audio processor 110 may cause the second speaker to not emit any sound waves (for example, if there are many users of the device 100).

The detector 190 may be any device configured to determine various characteristics of the user. For example, in some implementations, the detector 190 includes a camera configured to determine characteristics of the user or users of the device. In other implementations the detector 190 is a scanner that is configured to scan an area proximate the device 100 for particular objects. For example, the user or users may place an item (transmitter) on their person. The detector 190 may then be configured to scan the area proximate the device 100 to locate and determine a distance between the device 100 and the user or users.

As discussed above, in some implementations, the speakers 130 and 140 may be movably coupled to the device 100. In such implementations, the speakers 130 and 140 may be moved to adjust for the location of the user with respect to the device 100. For example, in some implementations, the detector 190 may be operatively coupled to the speakers 130 and 140 to move the speakers 130 and 140 to appropriately direct the sound waves produced by the speakers 130 and 140 to provide the appropriate sound waves to the user and to the areas surrounding the user.

In some implementations, the device 100 is configured to prompt the user for information regarding the user. For example, in some implementations, the user may be queried as to the location of the user with respect to the device 100. In other implementations, the user may be queried regarding other information, such as the distance between the user and the device 100 and the number of users of the device 100. The information provided by the user may be used to determine output of the speakers 130 and 140 of the device 100. For example, the volume or direction of the speakers 130 and 140 may be changed based on the information provided by the user.

In some implementations, the output of the speakers 130 and 140 of the device may be modified based on the current functionality of the device 100. For example, in some implementations, the output of the speakers 130 and 140 may be modified (for example, automatically via the audio processor 110) based on the application or program being run by the device 100. For example, if the user is viewing a video on a device 100 (such as a laptop computer) the second speaker 140 may be activated (to emit an anti-wave of the sound produced by the first speaker 130) and if the user is using a different program (such as a word processing program) the second speaker may be de-activated. Similarly, in some implementations, the second speaker 140 may be activated or de-activated based on the volume of the device (for example, the volume as selected by the user). In such implementations, the second speaker 140 may be activated when the selected volume is above a threshold volume and may be de-activated when the volume is below a threshold volume.

Figure 2:
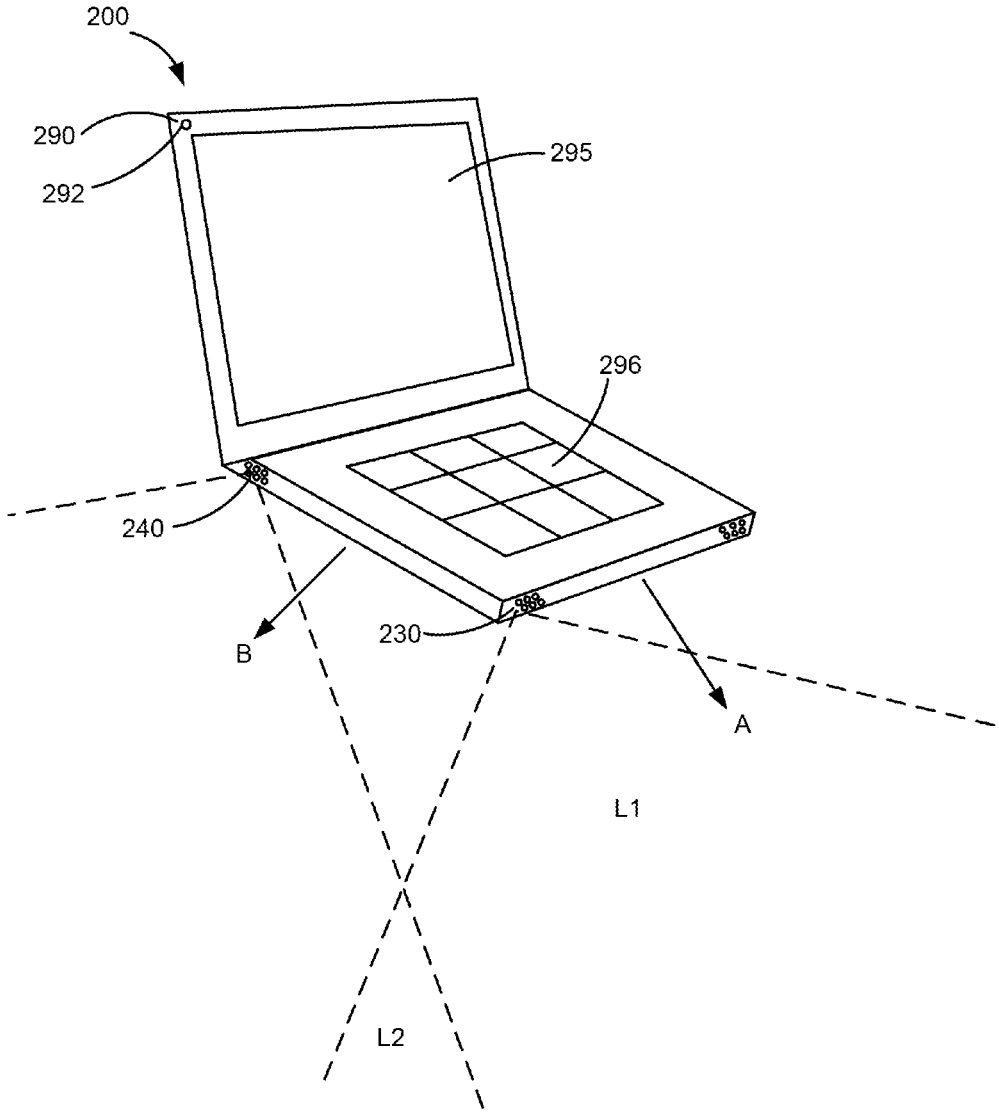
FIGS. 2-4 are perspective views of example devices according to implementations.

FIG. 2 is a perspective view of a device 200 according to an implementation. The device 200 is a laptop computer and includes a first speaker 230 and a second speaker 240. The device also includes an audio processor (not illustrated) that is operatively coupled to the first speaker 230 and the second speaker 240. Although the device 200 is illustrated as a conventional laptop computer, in some implementations, the device 200 is a tablet or other type of computing device.

The audio processor is configured to receive an audio signal. For example, in some implementations, the audio processor is configured to receive an audio signal that is associated with a sound or sounds (such as an audio stream).

The first speaker 230 is configured to produce, transmit, or emit sound waves. For example, in some implementations, the first speaker 230 is configured to receive an electrical signal corresponding to a sound wave from the audio processor and to produce or emit the sound wave from the device 200.

The second speaker 240 is configured to produce, transmit, or emit sound waves. For example, in some implementations, the second speaker 240 is configured to receive an electrical signal corresponding to a sound wave from the audio processor and to produce or emit the sound wave from the device 200.

The second speaker 240 is configured to produce or emit a sound wave that cancels the sound wave produced by the first speaker 230. In some implementations, the second speaker 240 is configured to produce or emit a sound wave that completely disrupts or cancels the sound wave produced by the first speaker 230. In such implementations, an individual that is exposed to both the sound wave of the first speaker 230 and the sound wave of the second speaker 240 does not hear or otherwise perceive either of the sound waves (and hears no sound). In other implementations, the second speaker 240 is configured to produce a sound wave that partially disrupts or cancels the sound wave produced by the first speaker 230. In such implementations, an individual exposed to both the sound wave of the first speaker 230 and the sound wave of the second speaker 240 does not completely hear the sound associated with the sound wave of the first speaker 230. For example, the sound that such individual hears is a limited, muffled, or otherwise disrupted or unrecognizable.

In some implementations, the second speaker 240 is configured to produce or emit a sound wave that is the anti-wave (i.e., the inverse wave) of the sound wave produced by the first speaker 230. In such implementations, the sound wave produced by the second speaker 240 (which is the anti-wave or inverse wave of the sound produced by the first speaker 230) combines with and cancel out the sound wave produced by the first speaker 230. Accordingly, an individual that receives or is exposed to the sound wave produced by the first speaker 230 and the sound wave that is produced by the second speaker 240 (the anti-wave of the sound wave produced by the first speaker 230) would not hear or recognize any sound.

In the illustrated implementation, the first speaker 230 is configured to emit sound waves from the device 200 in a first direction (in the direction of arrow A) and the second speaker 140 is configured to emit sound waves from the device 200 in a second direction (in the direction of arrow B) different than the first direction. Individuals may be positioned with respect to the device 200 such that they receive the sound waves produced by the first speaker 230 and do not receive the sound waves produced by the second speaker 240. Such individuals will perceive or hear the sounds associated with the sound waves produced by the first speaker 230. Also, individuals may be positioned with respect to the device 200 such that they receive the sound waves produced by the first speaker 230 and the second speaker 240. Such individuals will not perceive or hear any sounds associated with the sound waves produced by the first speaker 230 or the second speaker 240 (or will hear a partially canceled or disrupted sound associated with the sound wave produced by the first speaker).

Also in the illustrated implementation, the first speaker 230 is configured to emit sound waves from the device 200 to a first location L1 and a second location L2 different than the first location and the second speaker 240 is configured to emit sound waves from the device 200 to the second location L2 and not to the first location L1 (or is configured to emit sound waves to the first location L1 that are lower in intensity than the sound waves emitted to the second location L2). Individuals may be positioned at the first location L1 such that they receive the sound waves produced by the first speaker 230 and do not receive the sound waves produced by the second speaker 240. Such individuals will perceive or hear the sounds associated with the sound waves produced by the first speaker 230. Also, individuals may be positioned at the second location L2 such that they receive the sound waves produced by the first speaker 230 and the second speaker 240. Such individuals will not perceive or hear any sounds associated with the sound waves produced by the first speaker or the second speaker (or will hear a partially canceled or disrupted sound associated with the sound wave produced by the first speaker).

In the illustrated implementation, the device 200 includes a display 295 and a keyboard or input device 296. The display 295 is configured to provide visual outputs to the user for the device 200. For example, the display 295 may be configured to provide visual outputs that correspond to the sound or sets of sounds produced by the first speaker 230.

In the illustrated implementation, the device 200 includes an anti-wave generator (not illustrated). The anti-wave generator is configured to calculate or otherwise determine an anti-wave of a sound or a set of sounds. For example, in some implementations, the anti-wave generator is configured to receive a sound or set of sounds and to calculate the anti-wave of such sound or set of sounds. In some implementations, the anti-wave generator is operatively coupled to the second speaker 230 (for example, through the audio processor) to provide a signal associated with the anti-wave of the sound or set of sounds to the second speaker 240.

In the illustrated implementation, the device 200 includes a detector 290. The detector 290 is configured to detect the characteristics of the user or users of the device 200. For example, in some implementations, the detector 290 is configured to determine the distance between the device 200 and the user of the device 200. In other implementations, the detector 290 is configured to determine the relative location of the user of the device 200 with respect to the device 200. In yet further implementations, the detector 190 is configured to determine the number of users using the device 200.

The detector 290 is operatively coupled to the audio processor and is configured to provide information detected about the user of the device 200 to the audio processor. The audio processor may control the speakers 230 and 240 according to the information provided to it by the detector 290. For example, in some implementations, the audio processor may adjust the sound levels (or the relative sound levels) of the speakers depending on the distance of the user from the device. Also, in some implementations, the audio processor may cause the second speaker to not emit any sound waves (for example, if there are many users of the device 200).

In the illustrated implementation, the detector 290 includes a camera 292 configured to determine characteristics of the user or users of the device. In other implementations the detector 290 is a scanner that is configured to scan an area proximate the device 200 for particular objects. For example, the user or users may place an item (transmitter) on their person. The detector 290 may then be configured to scan the area proximate the device 200 to locate and determine a distance between the device 200 and the user or users.

In some implementations, the output of the speakers 230 and 240 of the device may be automatically modified based on the current functionality of the device 200 (i.e., based on the program that the device 200 is currently running). For example, if the user is viewing a video on the device 200 the second speaker 240 may be activated (to emit an anti-wave of the sound produced by the first speaker 230) and if the user is using a different program (such as a word processing program) the second speaker may be de-activated. Similarly, in some implementations, the second speaker 240 may be activated or de-activated based on the volume of the device (for example, the volume as selected by the user). In such implementations, the second speaker 240 may be activated when the selected volume is above a threshold volume and may be de-activated when the volume is below a threshold volume.

Figure 3:
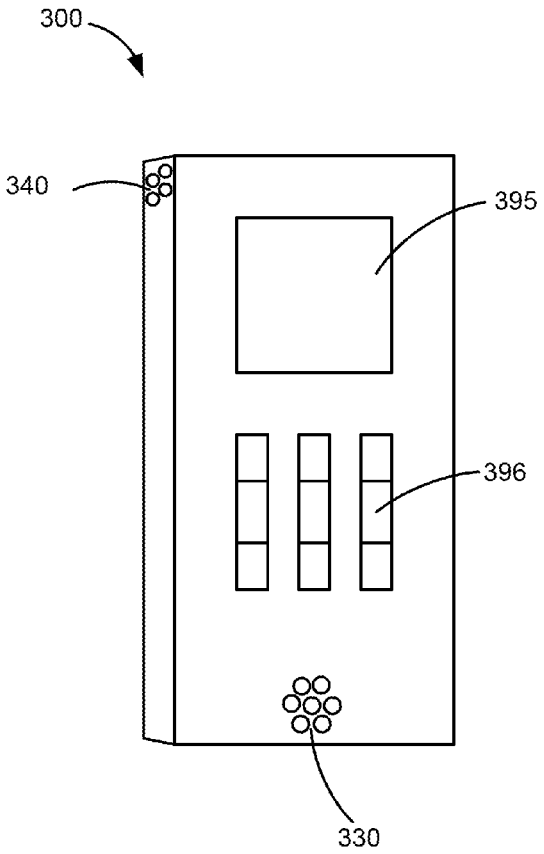

FIG. 3 is a perspective view of a device 300 according to an implementation. The device 300 includes a first speaker 330, a second speaker 340, a display 395 and an input device 396. In this implementation, the device 300 is a cellular or mobile phone.

In the illustrated implementation, the second speaker 340 can be activated and produce an anti-wave of the sound produced by the first speaker 330 when the device 300 is in specific modes. For example, the second speaker 340 can be activated when the device 300 is being used in speaker phone mode and can be deactivated with the device 300 is being used in a normal mode (holding the phone up to the ear of the user).

Figure 4:
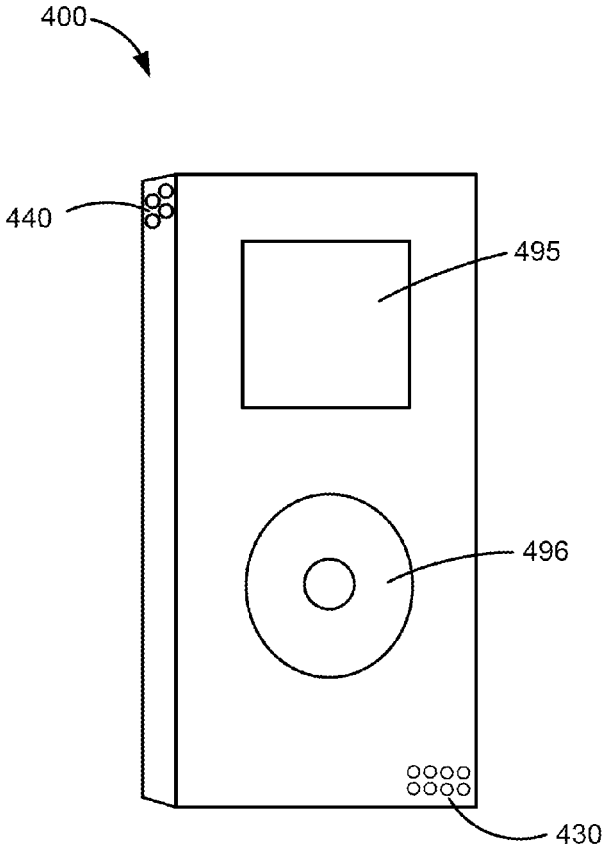

FIG. 4 is a perspective view of a device 400 according to an implementation. The device 400 includes a first speaker 430, a second speaker 440, a display 495 and an input device 496. In this implementation, the device 400 is a music player (such as an mp3 or other portable music player).

In the illustrated implementation, the second speaker 440 can be activated and produce an anti-wave of the sound produced by the first speaker 430 when the device 400 is in specific modes. For example, the second speaker 440 can be activated when the device 400 is being used in speaker mode (i.e., when the speaker 440 is emitting sound waves) and can be deactivated with the device 400 is being used in a headset mode (i.e., the user is listening to the device 400 via headphones)

Figure 5:
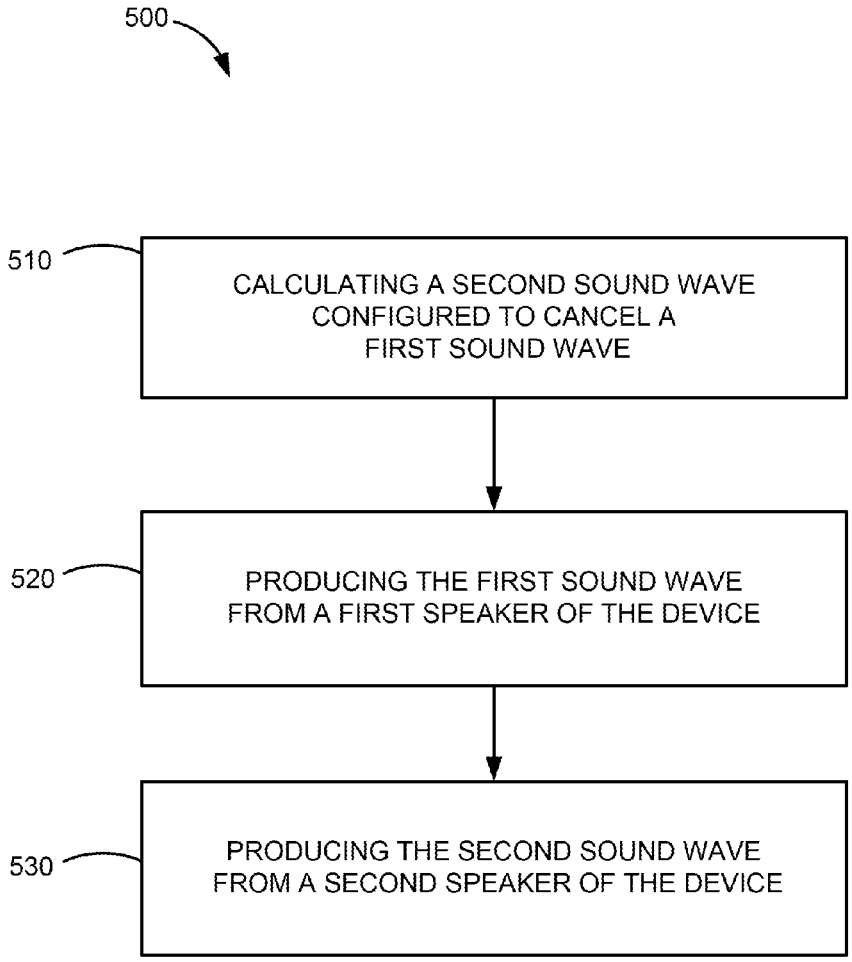
FIG. 5 is a flow chart of a method for transmitting sounds from a device according to an implementation.

FIG. 5 is a flow chart for a method of producing sound from a device. At step 510, a second sound wave is calculated or determined. The second sound wave is configured to cancel (or at least partially cancel) a first sound wave. In some implementations, the second sound wave is calculated by an anti-wave generator. In some implementations, the anti-wave generator calculates or determines a sound wave that when emitted from a second speaker is configured to cancel (or at least partially cancel) a sound wave emitted from a first speaker. In some implementations, the relative locations of the speakers are considered. In other words, the sound wave calculated by the anti-wave generator and emitted by the second speaker is offset by an amount equal to the distance between the first speaker and the second speaker.

At 520, the first sound wave is produced or emitted by the first speaker. At 530, the second sound wave is produced or emitted by the second speaker. In some implementations, the first sound wave and the second sound wave are produced simultaneously. In some implementations, the first sound wave produces or is associated with a sound that is associated with a visual output that is produced by the device.

In some implementations, the sound waves emitted by the first speaker are emitted in a direction different than the direction in which the sound waves of the second speaker are emitted. In some implementations, the sound waves emitted by the first speaker are emitted to a first location and to a second location. The sound waves of the second speaker are emitted to the second location but not to the first location. Thus, an individual in the first location would only receive the sound waves of the first speaker and an individual in the second location would receive sound waves from both of the speakers.

In some implementations, the method includes determining characteristics of the user of the device. For example, in some implementations, the method includes determining the distance between the device and the user of the device. In other implementations, the method includes determining the location of the user with respect to the device. In yet other implementations, the method includes determining how many users of the device there are.

In some implementations, the configurations of the speakers are changed or adjusted based on the characteristics of the user. For example, in some implementations, one of the speakers may be moved to direct sound waves toward the user. In other implementations, the volume of the relative volume of the speakers may be adjusted based on the number of users of the device.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or subcombinations of the functions, components and/or features of the different implementations described.

What is claimed is:

1. A computing device, comprising:

a display;

an audio processor configured to receive an audio signal;

a first speaker operatively coupled to the audio processor and disposed such that the first speaker emits sound waves in a first direction, the first speaker being configured to produce a first sound wave in a first location and a second location different than the first location, the first sound wave being associated with the audio signal and having a spatial intensity profile, the spatial intensity profile of the first sound wave being anisotropic; and a second speaker operatively coupled to the audio processor and disposed such that the second speaker emits sound waves in a second direction different than the first direction, the second speaker being configured to produce a second sound wave in the second location, the second sound wave having a spatial intensity profile, the spatial intensity profile of the second sound wave being anisotropic, the second sound wave being configured to at least partially cancel the first sound wave in the second location, the audio processor being configured to control the relative phases of the first sound wave and the second sound wave, the first speaker and the second speaker being activated when the computing device is operating a first computer program, the first speaker being activated and the second speaker being deactivated when the computing device is operating a second computer program different than the first computer program.

2. The device of claim 1, further comprising:

an anti-wave generator operatively coupled to the audio processor and configured to generate an audio signal representative of the second sound wave.

3. The device of claim 1, further comprising:

an anti-wave generator operatively coupled to the audio processor, the anti-wave generator being configured to receive the audio signal and to generate an audio signal representative of the second sound wave.

4. The device of claim 1, wherein the first speaker is configured to project the first sound wave to the first location at a first intensity and to the second location different than the first location at a second intensity, the first intensity being the same as the second intensity, the second speaker is configured to project the second sound wave to the second location at a third intensity and to the first location at a fourth intensity different than the third intensity.

5. The device of claim 1, wherein the first speaker is configured to project the first sound wave to the first location at a first intensity and to the second location different than the first location at a second intensity, the first intensity being the same as the second intensity, the second speaker is configured to project the second sound wave to the second location at a third intensity and to the first location at a fourth intensity different than the third intensity, such that a sound associated with the first sound wave is audible at the first location at a first sound level and is audible at the second location at a second sound level different than the first sound level.

6. The device of claim 1, wherein the audio signal is associated with a visual image displayed by the display.

7. The device of claim 1, further comprising:

an input device.

8. The device of claim 1, further comprising:

a detector operatively coupled to the audio processor and configured to detect a location of a user of the device.

9. The device of claim 1, further comprising:

a third speaker operatively coupled to the audio processor and configured to produce a third sound wave; and a fourth speaker operatively coupled to the audio processor and configured to produce a fourth sound wave, the fourth sound wave being configured to at least partially cancel the third sound wave.

10. The device of claim 1, wherein the device is at least one of a laptop computer and a tablet.

11. A method of transmitting sound waves from a computing device, comprising:

calculating a second sound wave, the second sound wave being configured to cancel a first sound wave;

producing the first sound wave in a first location and a second location different than the first location from a first speaker of the computing device; and activating a second speaker of the device if a volume level of the computing device is above a threshold level; and producing the second sound wave in the second location from the second speaker of the computing device when the second speaker is activated and cancelling the first sound wave in the second location.

12. The method of claim 11, further comprising:

transmitting the first sound wave in a first direction; and transmitting the second sound wave in a second direction different than the first direction.

13. The method of claim 11, further comprising:

transmitting the first sound wave to the first location and to the second location different than the first location; and transmitting the second sound wave to the second location but not to the first location.

14. The method of claim 11, further comprising:

displaying a visual image associated with a sound produced by the first sound wave.

15. The method of claim 11, further comprising:

detecting the location of a user of the device.

16. The method of claim 11, further comprising:

detecting a number of users of the device.

17. The method of claim 11, wherein the producing the first sound and producing the second sound occur simultaneously.

18. The method of claim 11, wherein the first and second sound waves are produced with different relative phases.

19. A computer program product tangibly embodied on a non-transitory computer-readable medium and comprising instructions that, when executed, are configured to cause at least one processor to:

receive a first sound wave;

calculate a second sound wave, the second sound wave being configured to at least partially cancel the first sound wave;

cause the first sound wave to be produced from a first speaker of a computing device in a first location and a second location different than the first location;

activate a second speaker of the computing device when a volume of the computing device is above a threshold level; and cause the second sound wave to be produced from the second speaker of the computing device in the second location when the second speaker is activated and at least partially cancelling the first sound wave in the second location.

20. The method of claim 11, wherein the computing device is at least one of a laptop computer and a tablet.

21. The computer program product of claim 19, wherein the computing device is at least one of a laptop computer and a tablet.

22. The device of claim 1, wherein the second speaker is configured to be activated when a volume of the computing device is above a threshold and be deactivated when the volume is below the threshold.

23. The device of claim 1, wherein the first speaker is movably coupled to the device and is configured to be moved with respect to the second speaker.

* * * * *